United States Patent [19]

Barker et al.

[11] 4,292,780

[45] Oct. 6, 1981

[54] STAGGERED BUTT SIDEWALL SHINGLE PANEL AND METHOD OF MAKING THE SAME

[75] Inventors: Craig S. Barker, Deerfield, Fla.; Joe L. Bockwinkel, Winlock, Wash.

[73] Assignee: Shakertown Corporation, Winlock, Wash.

[21] Appl. No.: 115,212

[22] Filed: Jan. 25, 1980

[51] Int. Cl.[3] ..... E04D 1/00

[52] U.S. Cl. ..... 52/541; 144/316; 144/326 R; 144/13

[58] Field of Search ..... 52/535, 540, 541; 428/165, 537; 144/13, 309 Q, 314 R, 315 R, 316, 326 R

[56] References Cited

U.S. PATENT DOCUMENTS

| | | | |
|---|---|---|---|
| 2,078,039 | 4/1937 | Stoner | 52/541 X |
| 2,823,426 | 2/1958 | Dunlap | 52/541 |
| 3,262,239 | 7/1966 | Mills | 52/540 |
| 3,809,598 | 5/1974 | Ferguson et al. | 144/13 |
| 4,191,722 | 3/1980 | Gould | 52/540 |

*Primary Examiner*—W. D. Bray

*Attorney, Agent, or Firm*—Robert W. Beach; Douglas E. Winters; Ward Brown

[57] ABSTRACT

A method of making wood shingle sidewall panels by assembling a lay-up having one layer of high-grade tapered wood shingles with a staggered butt edge, an intermediate layer of veneer and an opposite layer of low-grade wood shingles with an even butt edge and tapered opposite to the taper of the high-grade wood shingles; bonding the layers of the veneer; severing the panel blank so formed along a line located generally centrally between its opposite edges, thereby forming two sidewall panel blanks of a width approximately one-half the length of the shingles, one panel blank having staggered shingle butts and the other panel blank having even shingle butts; and thereafter cutting the panel blanks to length.

4 Claims, 11 Drawing Figures

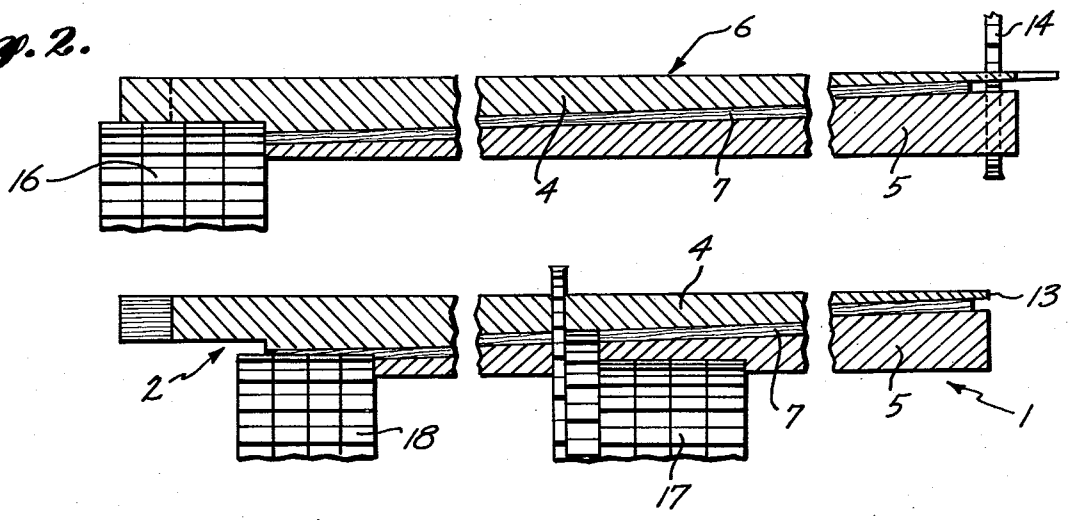
Fig. 2.
Fig. 3.
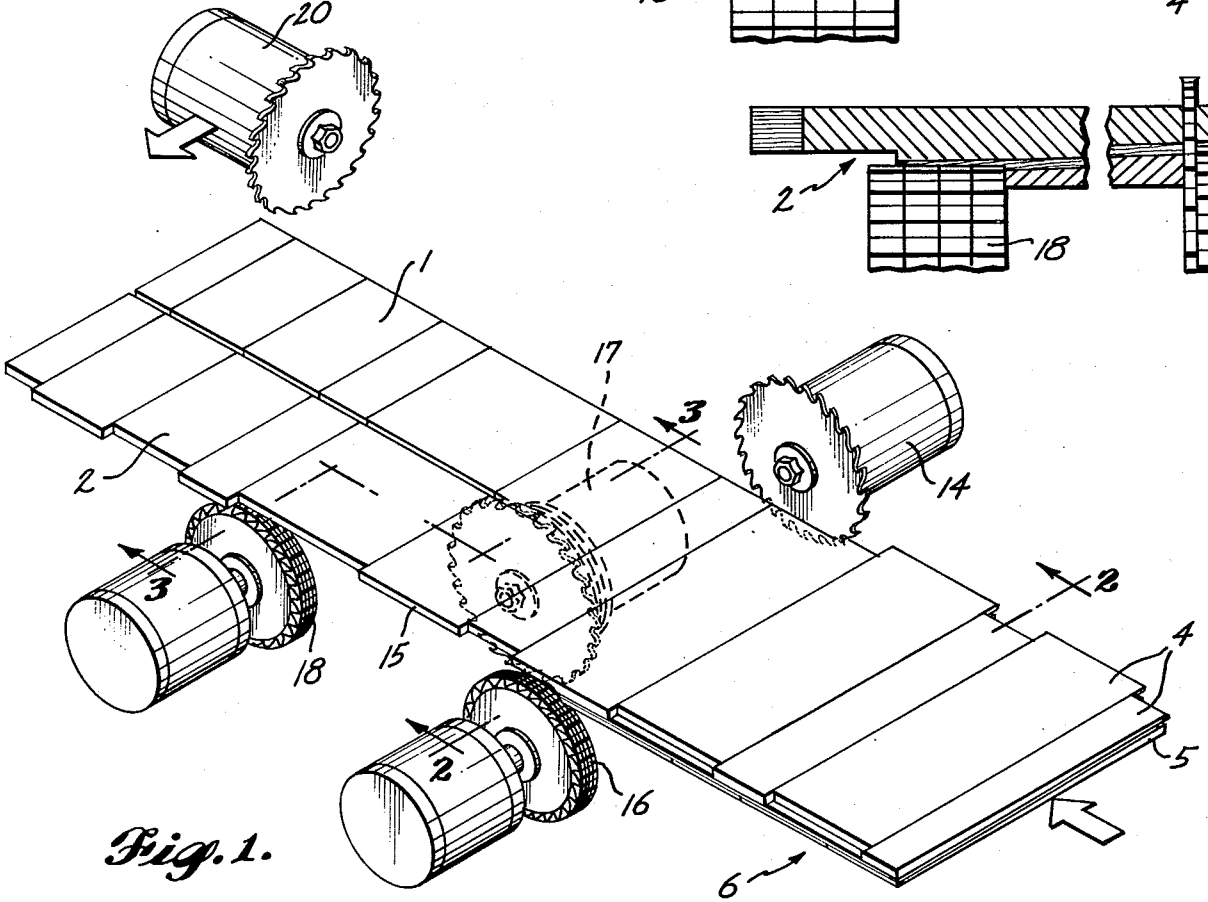
Fig. 1.

STAGGERED BUTT SIDEWALL SHINGLE PANEL AND METHOD OF MAKING THE SAME

BACKGROUND OF THE INVENTION

1. Field of the Invention

The present invention relates to staggered butt sidewall shingle panels and a method of manufacturing the panels. More particularly, it relates to the manufacture of interior or exterior colonial exposure, i.e. approximately 7 inch (17.78 cm) exposure, shingle panels with even or staggered butts for sidewalls or mansards.

2. Prior Art

In the past, 7 inch (17.78 cm) or colonial exposure panels with even butt edges have been made by assembling 18 inch (45.72 cm) panels and thereafter trimming both edges, routing a rabbet with a dado along the longitudinal center line and then cutting the panel along the center line forming two colonial, i.e. 8¼ inches wide (20.96 cm), shingle panels both having exposed shingles the butts of which are even.

The demand for an economical colonial exposure shingle panel with staggered butt edge had not been met because the only available staggered butt shingle panels were 16 inches or 18 inches wide. To obtain the colonial exposure, these panels were applied to sidewalls with over one-half of each panel underlying the next higher course of panels, resulting in the needless waste of expensive building material.

SUMMARY OF THE INVENTION

For the purpose of the present invention the designation "shingle" is used to designate a small thin piece of wood tapered from butt to tip usually 16 inches (40.64 cm) or 18 inches (45.72 cm) in length.

It is a principal object of the present invention to manufacture one staggered butt and one even butt colonial shingle panel from a single continuous laminated panel blank in a single operation.

Another object is to produce shingle panels which may be mounted on a sidewall or mansard which will produce an attractive and weather-resistant colonial exposure staggered butt shingle siding using a minimum of material.

BRIEF DESCRIPTION OF THE DRAWINGS

FIG. 1 is a schematic top perspective of apparatus for performing the method of the invention, showing saws and dadoes used to trim, rout and cut a continuous sheet shingle panel blank of the invention.

FIG. 2 is a section taken along line 2—2 of FIG. 1, parts being omitted.

FIG. 3 is a section taken along line 3—3 of FIG. 1.

DETAILED DESCRIPTION

Figure 10:
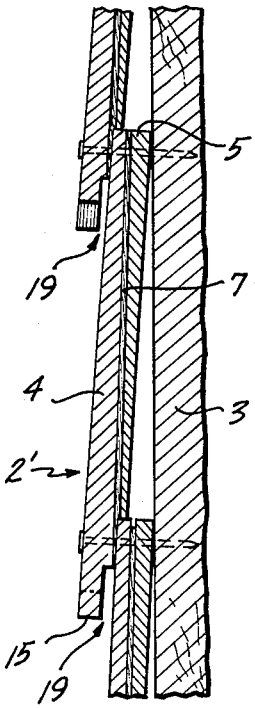
FIG. 10 is a vertical section showing staggered butt shingle panels of the invention applied to a sidewall.
Figure 11:
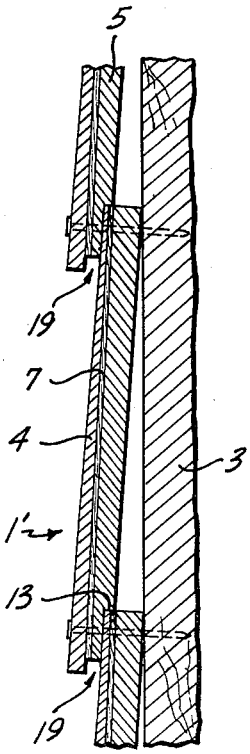
FIG. 11 is a vertical section of the even butt shingle panels of the invention applied to a sidewall.

As may be seen in FIG. 1, the process of the present invention yields two types of 7 inch (17.78 cm) or colonial exposure shingle panel blanks, namely, an even butt edge shingle panel blank 1 and a staggered butt edge shinle panel blank 2. The panel blanks may be cut to length forming even butt edge shingle panels 1' and staggered butt edge shingle panels 2' for application to a sidewall 3, as shown in FIGS. 10 and 11. Both panels include a high-grade tapered wood shingle 4 exposed and a low-grade tapered wood shingle 5 acting as sheathing for the shingle panel. The demand for staggered butt colonial exposure shingle panels may be met without wasting material, as would occur if full length 16 inch (40.64 cm) or 18 inch (45.72 cm) wide panels were mounted with a 7 inch (17.78 cm) exposure and the remaining 9 inches (22.86 cm) or 11 inches (27.94 cm) covered by the next higher course of shingles.

Figure 4:
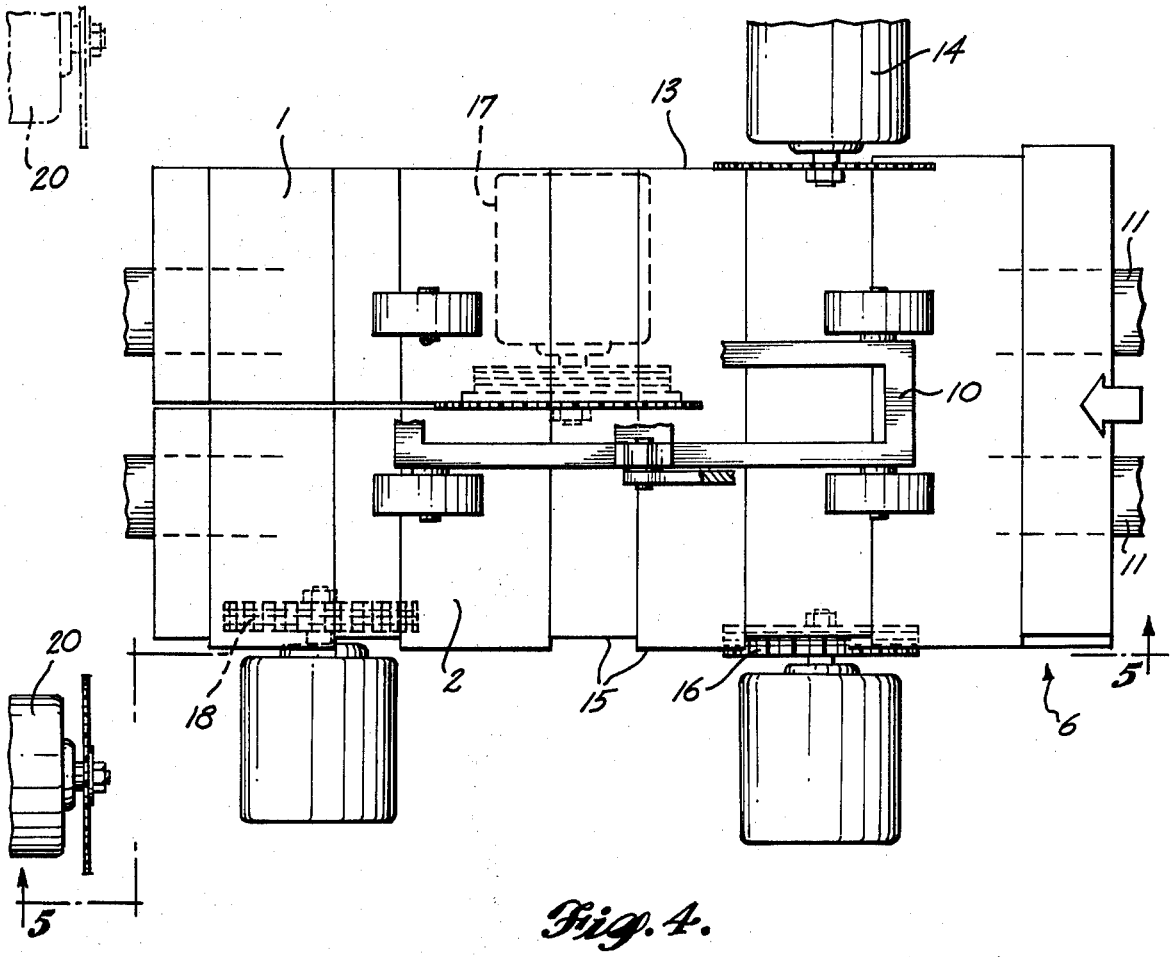
FIG. 4 is a plan of a machine to produce the shingle panels of the invention with parts broken away.
Figure 5:
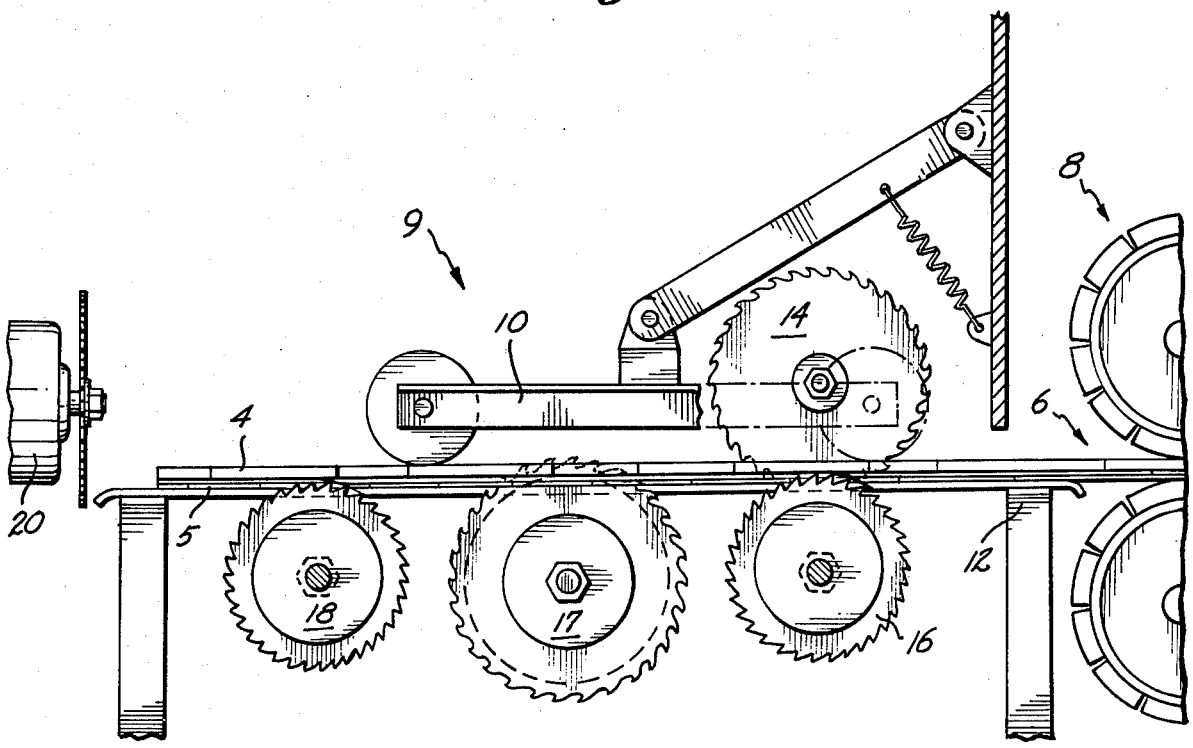
FIG. 5 is a section of the machine taken along line 5—5 of FIG. 4 with parts broken away.

A continuous sheet shingle panel blank, generally designated 6 in FIGS. 1, 4 and 5, is produced by laminating a low-grade tapered wood shingle (or backing shingle) layer 5, a veneer layer 7 and a high-grade tapered wood shingle (or face shingle) face layer 4. The shingles in the face layer are tapered in the direction opposite the direction of taper of the low-grade shingles in the backing layer 5. The low-grade backing shingles are laid up with the tip and butt edges in substantial alignment, a veneer sheet is laid up in substantial registration with the backing shingles and having its grain and length crossing the grain and length of the backing shingles, and the high-grade face shingles 4 are laid up with their butt edges in staggered relationship and with the projected shingle butts overhanging one edge of the veneer. The retracted shingle butts are located in substantial registration with such veneer edge. The lay-up with thermosetting adhesive between the layers is pressed and heated in conventional manner by a dielectrically heated press, generally designated 8 in FIG. 5, prior to reaching the machine of the present invention.

Figure 6:
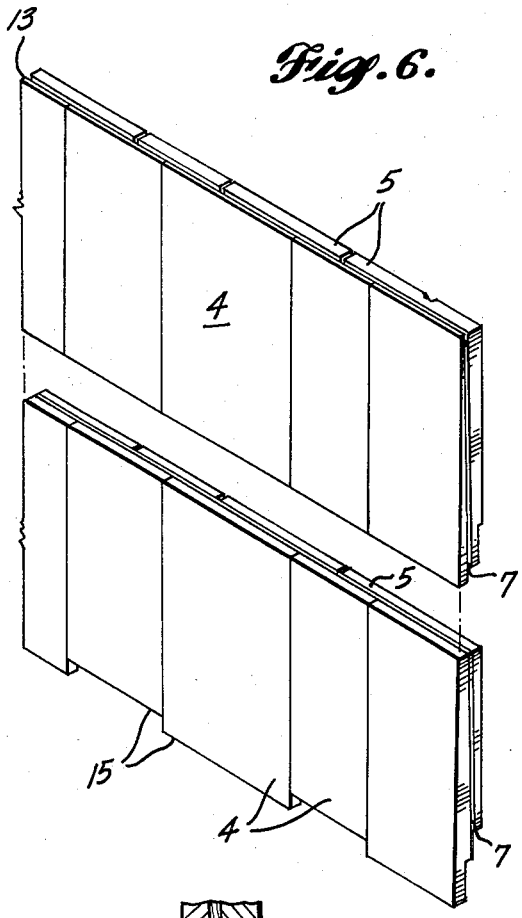
FIG. 6 is a front top perspective of the shingle panels of the invention.
Figure 7:
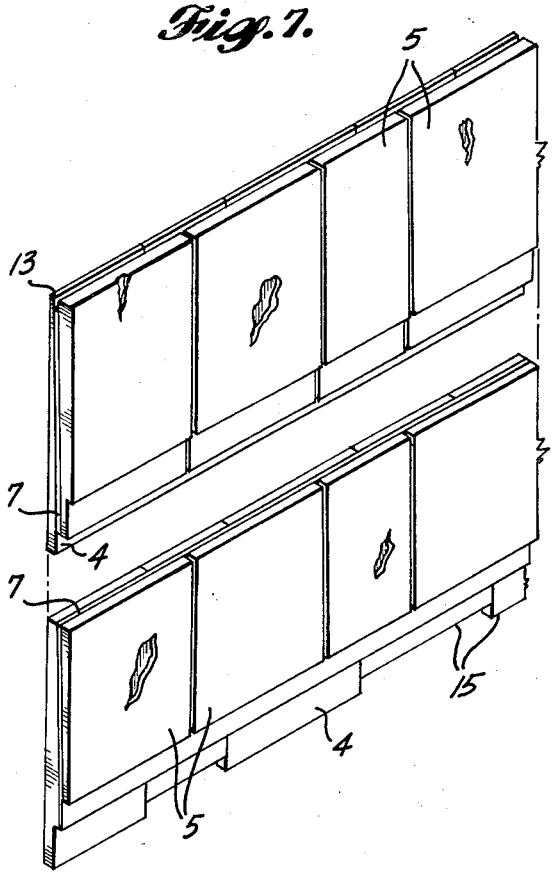
FIG. 7 is a rear top perspective of the shingle panels of the invention.

As shown in FIG. 7, low-grade shingles or culls with knots and/or flat grain may be used as the backing material. The backing shingles 5 need not be edge joined, but care should be taken to insure that the veneer end joints do not coincide with joints of either the backing or face shingles. As shown in FIG. 6, the face shingles 4 are arranged in edge-abutting relationship to create a more weather resistant barrier.

Referring now to FIGS. 4 and 5, upon being pressed and the adhesive cured in the heated press 8, a continuous sheet laminated shingle panel blank 6 enters the cutting and trimming section of the apparatus, generally designated 9. While the weight assembly 10 keeps the continuous sheet shingle panel blank pressed against endless belt 11 and cutting table 12, the continuous sheet blank is first simultaneously trimmed at the tip edge 13 by trim saw 14 and routed at the staggered butt edge 15 by dado 16. As best shown in FIG. 2, dado 16 cuts a rabbet into the staggered butt edge of the continuous sheet blank, removing the tip of the low-grade tapered wood shingle 5 and a portion of the thickness of veneer 7.

Next, trim saw/dado 17 cuts the continuous sheet shingle panel blank 6 generally along the center line into two continuous sheet blanks of approximately equal width. If the shingles are 16 inch shingles, each panel will be approximately 8 inches (20.32 cm) wide. If the shingles are 18 inch shingles, each panel will be approximately 9 inches (22.86 cm) wide. The double-dadoed trim saw/dado 17 simultaneously cuts the sheet blank 6 and routs two grooves or rabbets in the butt edge of the even butt continuous sheet blank 1. The routed edge of the sheet blank 1 is termed the butt edge since, as best shown in FIG. 3, while the laminated sheet is of uniform thickness the routed edge includes the exposed thicker edge of the face shingles 4, which is formed as a new butt edge by the lengthwise division of the originally laminated sheet blank.

The smaller diameter dado of trim saw/dado 17 removes a portion of the low-grade tapered wood shingle 5 and the larger diameter dado removes a portion of the low-grade tapered wood shingle 5 and a portion of the thickness of the veneer 7. Next, a second groove or rabbet is cut into the butt edge of the staggered butt edge continuous sheet blank 2 by dado 18. As shown in FIG. 3, that dado removes a portion of the low-grade tapered wood shingle 5 and the veneer 7.

Figure 8:
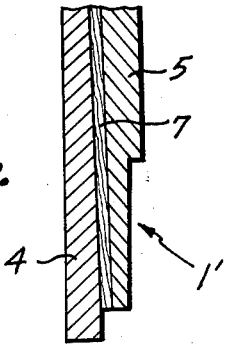
FIG. 8 is a transverse section of the lower portion of an even butt shingle panel of the invention.
Figure 9:
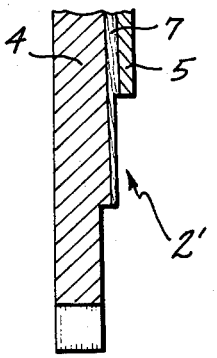
FIG. 9 is a transverse section of the lower portion of a staggered butt shingle panel of the invention.

The resulting butt edges are shown in FIG. 8 for the even butt edge shingle panel 1' and FIG. 9 for the staggered butt edge shingle panel 2'. As shown in FIGS. 10 and 11, when the shingle panels are mounted on the sidewall 3 the upper rabbet overlaps and abuts the tip edge of the next lower course of shingles, thereby automatically aligning the successive courses, and the lower rabbet creates an attractive shadow line 19. Also, as shown in FIGS. 10 and 11, both panels 1' and 2' are of uniform thickness and the panels are of equal thicknesses. The staggered butt edge panel 2' includes thicker high quality tapered wood face shingles 4 and thinner oppositely tapered low quality wood backing shingles 5, whereas the even butt edge panel 1' includes thinner high quality tapered wood face shingles 4 and thicker oppositely tapered low quality wood backing shingles 5. At the smooth or even edge of staggered butt edge panel 2', the end of the high quality wood face shingle 4 and the end of the low quality wood backing shingle 5 are of approximately equal thicknesses.

Finally, the continuous sheet blanks are cut to length, typically 8 feet (2.4 meters), by cutoff saw 20, shown in FIG. 1. The movement of the cutoff saw is synchronized with the movement of the continuous sheet blanks such that the cut is perpendicular to the trimmed tip edge 13 of the continuous sheet blank.

We claim:

1. In a process for making wood shingle sidewall panels of substantially uniform thickness including laying up a continuous sheet laminated shingle panel blank having a face layer of high quality tapered wood shingles in edge-abutting relationship arranged in a row transversely of their lengths and tapered in one direction, a backing layer of low quality tapered wood shingles opposite the face layer shingles and tapered in the direction opposite the direction of taper of the face layer shingles, and an intermediate veneer layer between the face and backing layers, bonding the face and backing layers of wood shingles to the opposite sides, respectively, of the intermediate veneer layer with the opposite rows of shingles substantially in registration lengthwise, severing the panel blank so formed along a line located generally centrally between its opposite edges, and cutting the panel blanks to length, the improvement comprising arranging the shingles in the face layer in staggered relationship prior to bonding the face layer to the veneer and thereby forming the sheet blank to be severed to form two sidewall panel blanks each of a width approximately one-half the length of the sheet blank shingles, one sidewall panel blank having face layer butt edges in staggered relationship and the other sidewall panel blank having substantially even butt edges.

2. The process defined in claim 1, including routing the butt edges of the two sidewall panel blanks and thereby forming an alignment rabbet and a shadow line in each of the two sidewall panel blanks.

3. The sidewall shingle panel produced by the process defined in claim 1 or 2.

4. In a sidewall shingle panel of substantially uniform thickness including a face layer of high quality tapered wood shingles in edge-abutting relationship arranged in a row transversely of their lengths and tapered in one direction, a backing layer of low quality tapered wood shingles opposite the face layer shingles and tapered in the direction opposite the direction of taper of the face layer shingles, and an intermediate veneer layer between and bonded to the face and backing layers, the improvement comprising the shingles of the backing layer being thinner than the shingles of the face layer, the shingle ends of the face and backing layers at one edge of the panel being even and being of approximately equal thickness and the butt ends of the face shingles at the opposite edge of the panel being staggered.

* * * * *